US011610456B2

(12) United States Patent
Lieb et al.

(10) Patent No.: US 11,610,456 B2
(45) Date of Patent: Mar. 21, 2023

(54) METHOD AND SYSTEM FOR CONDUCTING A GAME OF CHANCE

(71) Applicant: HOT STREAK LLC, Evanston, IL (US)

(72) Inventors: Michael Lieb, Streamwood, IL (US); Adam Margolis, Evanston, IL (US)

(73) Assignee: HOT STREAK LLC, Evanston, IL (US)

( * ) Notice: Subject to any disclaimer, the term of this patent is extended or adjusted under 35 U.S.C. 154(b) by 0 days.

(21) Appl. No.: 17/478,729

(22) Filed: Sep. 17, 2021

(65) Prior Publication Data

US 2022/0092944 A1 Mar. 24, 2022

Related U.S. Application Data

(60) Provisional application No. 63/080,480, filed on Sep. 18, 2020.

(51) Int. Cl.

| | |
|---|---|
| ***G07F 17/00*** | (2006.01) |
| ***G07F 19/00*** | (2006.01) |
| ***G07F 17/32*** | (2006.01) |

(52) U.S. Cl.

CPC ..... *G07F 17/3293* (2013.01); *G07F 17/3244* (2013.01); *G07F 17/3262* (2013.01); *G07F 17/3276* (2013.01)

(58) Field of Classification Search

CPC ..... G07F 17/3244; G07F 17/3262; G07F 17/3276; G07F 17/3293; A63F 1/00;

(Continued)

(56) References Cited

U.S. PATENT DOCUMENTS 5,718,431 A * 2/1998 Ornstein ..... A63F 3/00157 273/274

7,867,080 B2 * 1/2011 Nicely ..... A63F 3/00157 463/25

(Continued)

OTHER PUBLICATIONS

"Instant Win Game | 5 to 6 Hi Lo Line up" by BlushBombVideos. YouTube—Broadast Yourself. [dated Mar. 25, 2011], [online], [retrieved on Jun. 16, 2022]. <URL:https://www.youtube.com/watch?v=sl74V73M1PQ>. 3 Pages. (Year: 2011).*

(Continued)

*Primary Examiner* — Milap Shah

(74) *Attorney, Agent, or Firm* — Lewis Roca Rothegerber Christie LLP

(57) ABSTRACT

A method of conducting a game of chance, the method including displaying first cards for active lines, and providing a prompt for eliciting a first response, the first response including an indication that a next card will be higher in value than a preceding card for an active line from among the active lines or an indication that a next card will be lower in value than a preceding card for an active line from among the active lines. The method further includes displaying a next card for the active lines, determining active lines remaining based on the indication of the first response, updating a streak number corresponding to a number of responses in the game that include indications resulting in active lines remaining, and determining a reward based on the active lines remaining in response to the streak number reaching a threshold value.

16 Claims, 12 Drawing Sheets

(58) Field of Classification Search
CPC ..... A63F 3/00157; A63F 2001/003; A63F 2001/005; A63F 2001/006; A63F 2001/008
USPC ..... 463/11–13; 273/292
See application file for complete search history.

(56) References Cited

U.S. PATENT DOCUMENTS 8,235,780 B2 * 8/2012 Nicely ..... G07F 17/3276 463/16
8,562,419 B2 * 10/2013 Nicely ..... G07F 17/3286 463/16
2003/0199297 A1 * 10/2003 Falciglia, Sr. ..... G07F 17/3293 463/16
2004/0116179 A1 * 6/2004 Nicely ..... G07F 17/32 463/25
2007/0135193 A1 * 6/2007 Nicely ..... G07F 17/3293 463/11
2014/0087829 A1 * 3/2014 Watkins ..... G07F 17/3267 463/20
2016/0210813 A1 * 7/2016 Baerlocher ..... G07F 17/3225
2020/0234528 A1 * 7/2020 McKee ..... G07F 17/3288
2021/0174645 A1 6/2021 Moody

OTHER PUBLICATIONS

"Hi-Lo by Gamesys," Web Page <https://online.worldcasinodirectory.com/gamesys/hi-lo>, 2 pages, retrieved on Dec. 2021.
"Ultimate HiLo by Wager Gaming," Web Page <https://online.worldcasinodirectory.com/wager-gaming/ultimate-hilo>, 2 pages, retrieved on Dec. 2021.
"5 of 6 Hi-Lo Line-Up by IGT Interactive," Web Page <https://online.worldcasinodirectory.com/igt/5-of-6-hi-lo-line-up>, 2 pages, retrieved on Dec. 2021.

* cited by examiner

METHOD AND SYSTEM FOR CONDUCTING A GAME OF CHANCE

CROSS-REFERENCE TO RELATED APPLICATION(S)

This application claims priority to and the benefit of U.S. Provisional Application No. 63/080,480, filed on Sep. 18, 2020, entitled "METHOD AND SYSTEM FOR CONDUCTING A NEW CARD GAME" the entire content of which is incorporated by reference herein.

FIELD

Aspects of some embodiments of the present disclosure relate to a system and method for conducting a game of chance.

BACKGROUND

In recent years, a growing number of games have become readily available in today's highly competitive gaming market. These games belong to a variety of genres and include a variety of elements designed to attract players. For example, each game constantly competes for the attention of potential players using an array of techniques ranging from audiovisual cues to particular gameplay elements. Further, game providers are continously optimizing monetization strategies and the attractivenes of the games they present to potential players.

The above information disclosed in this Background section is for enhancement of understanding of the background of the present disclosure, and therefore, it may contain information that does not constitute prior art.

SUMMARY

Aspects of one or more embodiments of the present disclosure are directed toward a game of chance that enhances the entertainment experience of a player. The game of chance may be relatively easy to learn and play, have relatively quick gameplay, and provide the player with options.

According to one or more embodiments of the present disclosure, there is provided a method of conducting a game of chance, the method includes displaying, by a processing circuit, first cards for active lines from among a plurality of lines of play; providing, by the processing circuit, a prompt for eliciting a first response, the first response including: an indication that a next card will be higher in value than a preceding card for an active line from among the active lines; or an indication that a next card will be lower in value than a preceding card for an active line from among the active lines; in response to receiving, by the processing circuit, the first response: displaying, by the processing circuit, a next card for the active lines; and determining, by the processing circuit, active lines remaining from among the plurality of lines of play based on the indication of the first response; updating, by the processing circuit, a streak number corresponding to a number of responses in the game that include indications resulting in active lines remaining from among the plurality of lines of play; and determining, by the processing circuit, a reward based on the active lines remaining from among the plurality of lines of play in response to the streak number reaching a threshold value.

In one or more embodiments, the game includes one or more standard decks of cards.

In one or more embodiments, the active lines from among the plurality of lines of play include cards displayed, by the processing circuit, from respective standard decks of cards In one or more embodiments, the first cards for the active lines are equal to each other in value.

In one or more embodiments, the method further includes providing, by the processing circuit, a prompt for eliciting a second response, the second response comprising an election to replace one or more cards in the plurality of lines.

In one or more embodiments, prior to receiving, by the processing circuit, the first response, the method further includes determining, by the processing circuit, that an active line remains from among the plurality of lines of play based on an auto-win card regardless of the first response and the next card for the active line.

In one or more embodiments, the method further includes providing, by the processing circuit, a prompt for eliciting a third response, the third response including an option to place a side bet to protect against a chance of a tie between the next card and the preceding card.

In one or more embodiments, the method further includes increasing, by the processing circuit, the reward based on a combination of cards in accordance with a pay table.

In one or more embodiments, the combination of cards includes cards from two or more of the active lines remaining from among the plurality of lines of play in response to the streak number reaching the threshold value.

In one or more embodiments, a method of hosting a competition includes a plurality of users, the method including: conducting a first game of chance according to the method of one or more embodiments for a user from among the plurality of users; conducting a second game of chance according to the method of one or more embodiments for another user from among the plurality of users; and determining, by a processing circuit, a winning user from among the plurality of users based on a number of completed streaks or rewards received by the winning user.

According to one or more embodiments of the present disclosure, there is provided a system of conducting a game of chance, the system includes a display device to display a user interface and a processing circuit connected to the display device, the system being configured to: display, by the processing circuit, first cards for active lines from among a plurality of lines of play; provide, by the processing circuit, a prompt for eliciting a first response, the first response including: an indication that a next card will be higher in value than a preceding card for an active line from among the active lines; or an indication that a next card will be lower in value than a preceding card for an active line from among the active lines; in response to receiving, by the processing circuit, the first response: display, by the processing circuit, a next card for the active lines; and determine, by the processing circuit, active lines remaining from among the plurality of lines of play based on the indication of the first response; update, by the processing circuit, a streak number corresponding to a number of responses in the game that include indications resulting in active lines remaining from among the plurality of lines of play; and determine, by the processing circuit, a reward based on the active lines remaining from among the plurality of lines of play in response to the streak number reaching a threshold value.

In one or more embodiments, the game comprises one or more standard decks of cards.

In one or more embodiments, the active lines from among the plurality of lines of play comprise cards displayed, by the processing circuit, from respective standard decks of cards.

In one or more embodiments, the first cards for the active lines are equal to each other in value.

In one or more embodiments, the system is configured to provide, by the processing circuit, a prompt for eliciting a second response, the second response comprising an election to replace one or more cards in the plurality of lines.

In one or more embodiments, prior to receiving, by the processing circuit, the first response, the system is configured to determine, by the processing circuit, that an active line remains from among the plurality of lines of play based on an auto-win card regardless of the first response and the next card for the active line.

In one or more embodiments, the system is configured to provide, by the processing circuit, a prompt for eliciting a third response, the third response comprising an option to place a side bet to protect against a chance of a tie between the next card and the preceding card.

In one or more embodiments, the system is configured to increase, by the processing circuit, the reward based on a combination of cards in accordance with a pay table.

In one or more embodiments, the combination of cards comprises cards from two or more of the active lines remaining from among the plurality of lines of play in response to the streak number reaching the threshold value.

In one or more embodiments, a system of hosting a competition comprising a plurality of users, the system including: conducting a first game of chance according to the system of one or more embodiments for a user from among the plurality of users; conducting a second game of chance according to the system of one or more embodiments for another user from among the plurality of users; and determining, by a processing circuit, a winning user from among the plurality of users based on a number of completed streaks or rewards received by the winning user.

BRIEF DESCRIPTION OF THE DRAWINGS

The above and other aspects and features of the present disclosure will be more clearly understood from the following detailed description of the illustrative, non-limiting example embodiments with reference to the accompanying drawings.

FIG. 1A is a flow chart illustrating a method of conducting a game of chance according to one or more embodiments of the present disclosure.

DETAILED DESCRIPTION

Figure 14:
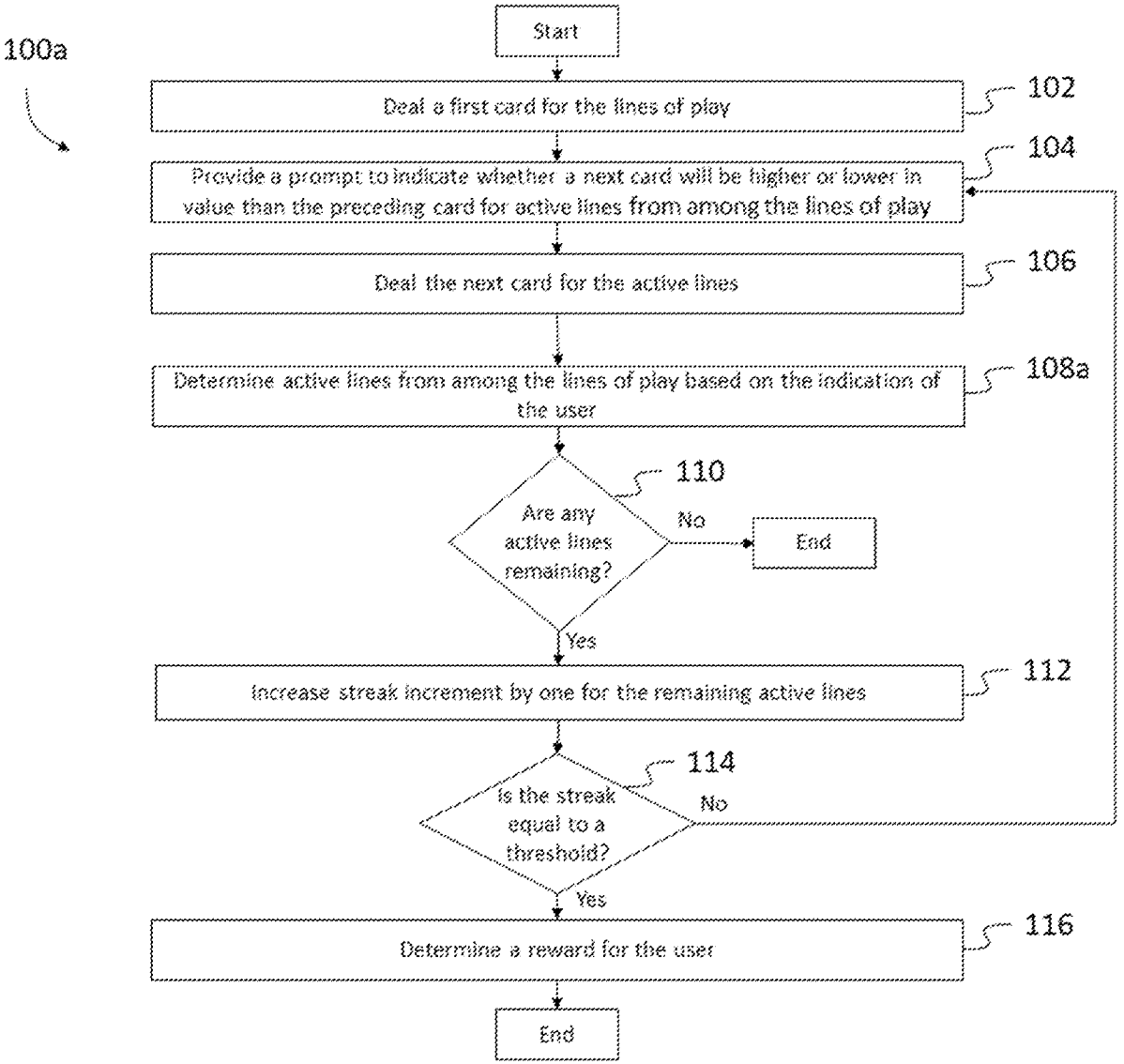

Hereinafter, example embodiments will be described in more detail with reference to the accompanying drawings, in which like reference numbers refer to like elements throughout. The present disclosure, however, may be embodied in various different forms, and should not be construed as being limited to only the illustrated embodiments herein. Rather, these embodiments are provided as examples so that this disclosure will be thorough and complete, and will fully convey the aspects and features of the present disclosure to those skilled in the art. Accordingly, processes, elements, and techniques that are not necessary to those having ordinary skill in the art for a complete understanding of the aspects and features of the present disclosure may not be described. Unless otherwise noted, like reference numerals denote like elements throughout the attached drawings and the written description, and thus, description thereof may not be repeated.

Generally, one or more embodiments of the present disclosure combine the elements of simplicity, strategy, speed, flexibility, and jackpot potential into a game of chance to attract and retain players (or users of, for example, an electronic device or a gaming apparatus). In one or more embodiments, the rules of the game of chance are easy to learn, allow players to make calculated decisions, progress at an adjustable speed in an understandable loop for continuous play, and provide players with the potential to win large multiples on a bet. Further, the core gameplay of the game of chance may be modified based on a number of separate variations as described herein to provide an array of possibilities that may improve player retention.

In general, the game may be played with any number of devices capable of generating random numbers or pseudo-random numbers, such as dice, cards, or an electronic random number generator. In one or more embodiments that use cards as the pseudo-random number generator, the player may be presented with the same starting card for multiple lines of play with each line of play having its own deck of cards. The player may then guess whether the next card to be presented is higher or lower than the previous card in a line of play with the player's guess being valid for one or more of the lines of play (e.g., all of the lines of play). Play continues until either no streaks of correct guesses remain (e.g., the player guessed incorrectly for all of the lines of play), or the player has completed at least one streak of a threshold number of correct guesses (e.g., four correct guesses). The threshold number of correct guesses may be any suitable number of guesses (e.g., any predetermined number of consecutive correct guesses to complete a streak). The player may then be awarded credits based on how many completed streaks they have achieved.

Figure 1B:
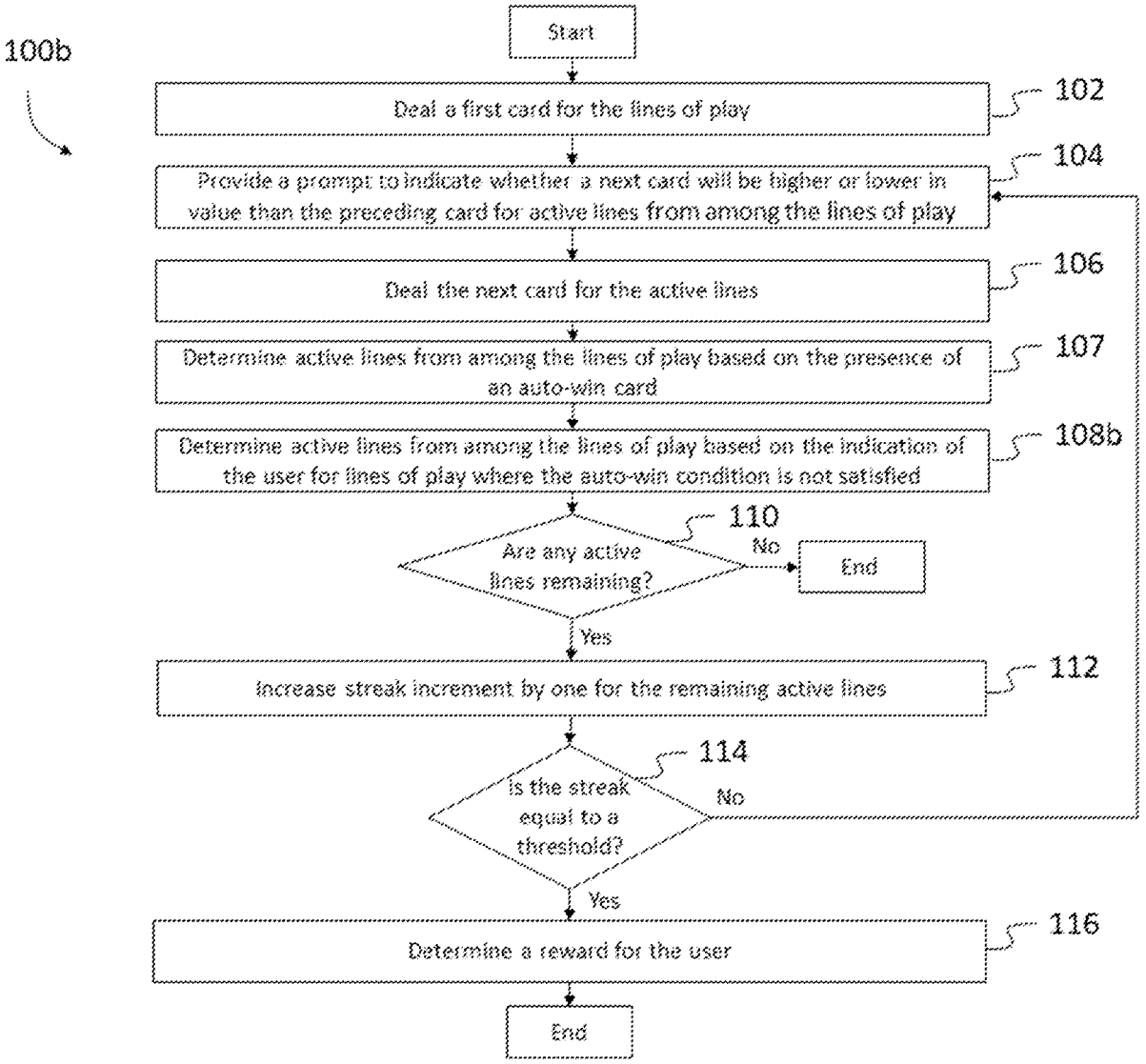
FIG. 1B is a flow chart illustrating a method of conducting a game of chance according to one or more embodiments of the present disclosure.
Figure 1C:
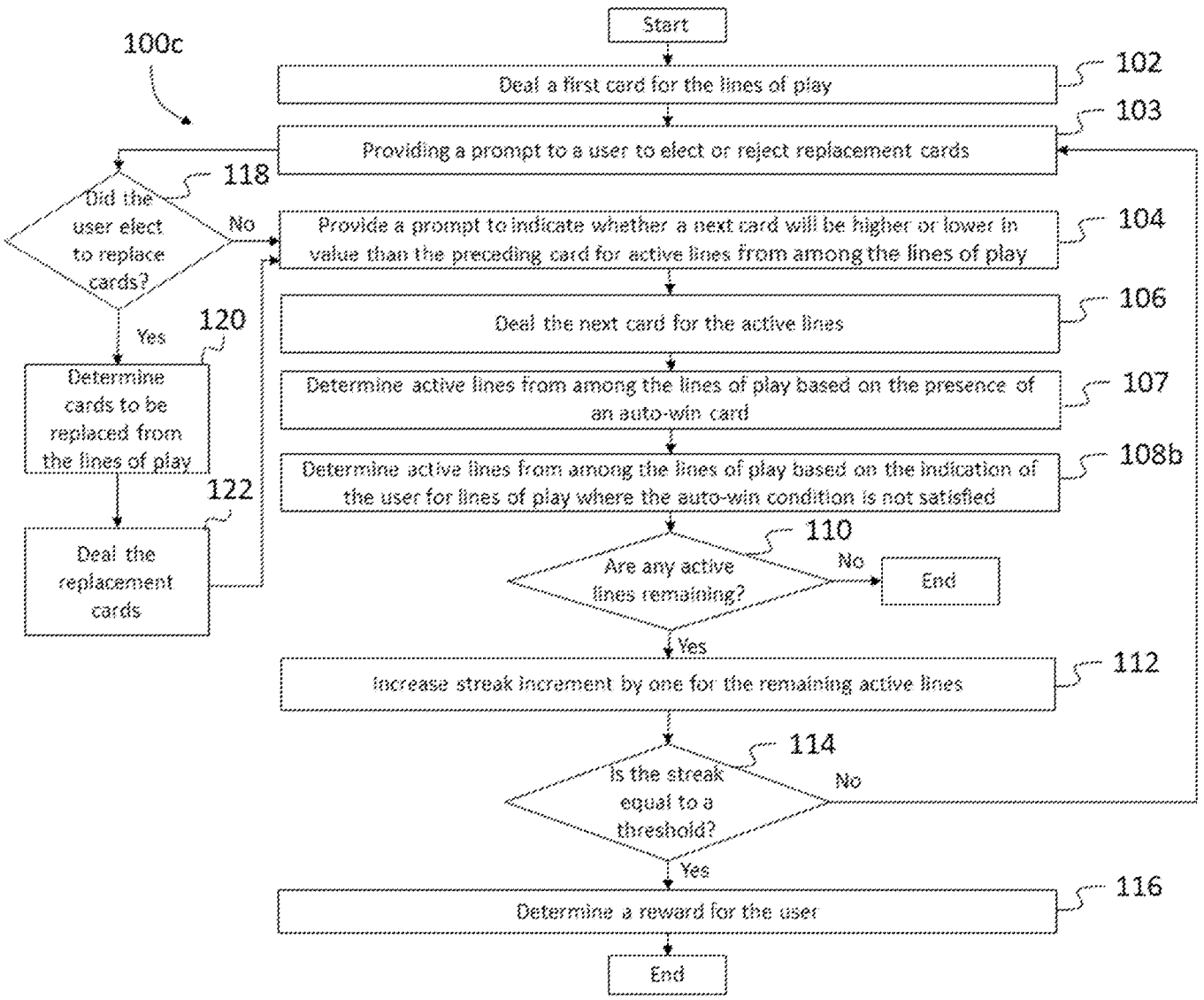
FIG. 1C is a flow chart illustrating a method of conducting a game of chance according to one or more embodiments of the present disclosure.

FIG. 1A is a flow chart illustrating a method of conducting a game of chance, more particularly, a card game according to one or more embodiments of the present disclosure. FIG. 1B is a flow chart illustrating a method of conducting a game of chance according to one or more embodiments of the present disclosure. FIG. 1C is a flow chart illustrating a method of conducting a game of chance according to one or more embodiments of the present disclosure.

The methods of conducting a game of chance in accordance with FIGS. 1A-1C may be performed by a host or a dealer. The host may wish to conduct the game of chance to entertain one or more users or players for free or in exchange for goods and/or services. The host may be a person or a robot executing the method of conducting the game of chance in the physical world (e.g., using physical cards on a physical table) with verbal, non-verbal, and/or other suitable forms of communication in accordance with the methods of FIGS. 1A-1C, or a processing circuit conducting the game of chance electronically in communication with a user interface in accordance with the methods of FIGS. 1A-1C.

As used herein, the term "processing circuit" refers to any combination of hardware, firmware, and software, employed to process data or digital signals. Processing circuit hardware may include, for example, application specific integrated circuits (ASICs), general purpose or special purpose central processing units (CPUs), digital signal processors (DSPs), graphics processing units (GPUs), and programmable logic devices such as field programmable gate arrays (FPGAs). In a processing circuit, as used herein, each function is performed either by hardware configured (i.e., hard-wired, to perform that function) or by more general purpose hardware, such as a CPU, configured to execute instructions stored in a non-transitory storage medium. A processing circuit may be fabricated on a single printed circuit board (PCB) or distributed over several interconnected PCBs. A processing circuit may contain other processing circuits; for example, a processing circuit may include two processing circuits, an FPGA and a CPU, interconnected on a PCB.

As such, some or all of the operations described herein may be performed by one or more processing circuits. For example, the processing circuit may deal (or display) cards, receive input from one or more users, provide prompts to the user, determine active and inactive lines, perform award calculations, and/or coordinate competitive events as will be discussed herein.

In one or more embodiments, a method of conducting the card game involves one or more separate decks. The one or more separate decks may be one or more standard decks of 52 cards. However, the present disclosure is not limited thereto. For example, the one or more separate decks may be any suitable deck including cards with set values relative to each other. In other words, any deck including cards that may be identified as lower, the same, and/or higher in value than other cards of the deck may be used in accordance with one or more embodiments of the present disclosure.

Further, the card game may include multiple lines of play (e.g., two or more lines of play) corresponding to one or more separate decks. For example, a single line of play may correspond to a single deck such that each line of play corresponds to a single deck. As another example, more than one line of play (e.g., two or more lines of play) may correspond to a single deck. Therefore, as yet another example, all of the lines of play may be dealt (or displayed) from a single deck. As such, it should be apparent that any suitable variation of lines of play relative to a number of decks may be used.

As used herein, the term "active lines" refer to lines of play that are in play (i.e., not removed from play) at a given time. For example, at the start of the card game, all of the lines of play in the game may be considered active lines. However, based on decisions made by the user and/or determinations by the host, one or more active lines may be rendered inactive for reasons that will be described herein.

With reference to FIG. 1A, the method 100*a* of conducting the card game includes dealing (or displaying) to a user a first card (e.g., a starting card or an initial card) for each line of play (102). The first card for a line of play may be dealt (or displayed) from the same deck used for subsequent cards of that line of play. However, the present disclosure is not limited thereto. For example, the first card may be a card dealt (or displayed) from a starting deck that is separate from the one or more decks used for particular lines of play. In this case, the aspects of the first card (e.g., the value of the first card) may not affect the probability of subsequently dealt cards (e.g., the same card) from the one or more decks used for particular lines of play.

In one or more embodiments, the host may deal (or display) a random or pseudo-random card as the first card to a line of play and, based on that card, deal (or display) identical first cards to the other lines of play. As such, if the first card dealt (or displayed) has a corresponding value (e.g., a queen), then the first cards dealt (or displayed) to the other lines of play may be the same in value (e.g., the first cards dealt to the other lines of play may be an identical queen). However, the present disclosure is not limited thereto. For example, the first card dealt (or displayed) for each line of play may be independently dealt (i.e., not based on each other) in a random or pseudo-random manner, and therefore, may be different from each other.

When dealing (or displaying) the cards to be viewed by the user, the host may arrange the cards in a matrix arrangement based on the lines of play. For example, the lines of play may be spaced from each other in a first direction (e.g., a column direction) in a plan view (e.g., see the top down view of FIGS. 2-8) and each line of play may extend in a second direction (e.g., a row direction) crossing the first direction in the plan view.

Although a matrix arrangement is described and shown in the drawings, the present disclosure is not limited thereto. For example, any arrangement of the lines of play may be used such that the lines of play are distinguishable from each other and a sequence of dealt (or displayed) cards within respective lines of play are understood by the user.

After the host deals (or displays) the first card, the user may be provided with a prompt (or option) to indicate (e.g., guess) whether a next card will be higher or lower in value than the preceding card (e.g., the immediately preceding card) for active lines from among the lines of play (104). In one or more embodiments, after the first card has been dealt (or displayed) for a line of play but before a second card has been dealt (or displayed) for the line of play, the preceding card may be the first card and the next card may be the second card that will be dealt (or displayed). As another example, after the first card and the second cards have been dealt (or displayed) for a line of play but before a third card has been dealt (or displayed) for the line of play, the preceding card may be the second card and the next card may be the third card that will be dealt (or displayed). Accordingly, it should be understood from the above-mentioned examples, that the "next card" and the "preceding card" may change depending on the state of the game (e.g., the last card dealt to the active lines).

In one or more embodiments, the indication of whether the next card will be higher or lower in value than the preceding card for the active lines applies to all active lines.

For example, if the user indicates that the next card will be higher in value for one active line then the user must also indicate that the next cards will be higher in value for all of the other active lines. Similarly, if the user indicates that the next card will be lower in value for one active line then the user must also indicate that the next cards will be lower in value for all of the other active lines. However, the present disclosure is not limited thereto.

For example, in one or more embodiments, different guesses may be allowed for different lines of play. For instance, a guess of higher and lower may be applicable to a specific active line on a line-by-line basis or any other suitable basis (e.g., groupings of lines). Further, the indications are not limited to higher or lower in value. For example, one or more additional or different options may be presented referring to different aspects of a card or outcomes such as a tie, a difference in suit, and/or the like.

In one or more embodiments, the host may present the user with the option to place a side bet on the chance of a tie for one or more active lines thereby providing a form of insurance against potentially losing an active line due to the next card resulting in a tie. Further, in one or more embodiments, the host may present (or provide) the user with the option to place a side bet on a particular card value for the next card to be dealt (or displayed) to one or more active lines. Accordingly, as should be apparent from the above-mentioned description, any suitable variation of possible side bet options may be provided by the host to expand options provided in the card game.

In response to receiving the indication, from the user, of whether the next card will be higher or lower in value than the preceding card for the active lines of play, the host deals (or displays) the next card for active lines from among the lines of play (106).

The host may then determine active lines among the lines of play (108) based on whether the indication by the user is correct or incorrect for each of the active lines of play. In the case where a guess is incorrect, the corresponding line of play may be rendered inactive or removed from play, and in the case where a guess is correct, the corresponding line of play may remain active or in play. In the event of a tie, the corresponding line of play may be rendered inactive or removed from play. However, the present disclosure is not limited thereto. For example, in one or more embodiments, the tie may result in the corresponding line of play remaining active.

In one or more embodiments, the host may determine whether any active lines are remaining (110). In the case where no active lines are remaining, the card game may end and the host may give the user the option to restart the card game (i.e., begin a new play of the card game).

In the case where active lines remain, the host may increase a streak increment by one for the remaining active lines (112). The host may then determine whether the streak is equal to a threshold (or a threshold value) (114) indicating completion of the streak and conclusion of the card game. In one or more embodiments, the threshold may be four to correspond to four correct guesses. In other words, the conclusion of the card game is reached when one or more active lines reach a streak of four (e.g., four correct guesses). However, the present disclosure is not limited thereto any threshold value may be used.

In the case where the streak is below the threshold, play may continue for each active line (e.g., a line where one or more correct indications have been indicated by the user with no incorrect indications). Play may continue by repeating acts 102, 104, 106, 108, 110, 112, and 114 until no remaining active lines exist or the host determines that the streak is equal to a threshold (or a threshold value) indicating completion of the streak and conclusion of the card game.

When the host determines that the streak is equal to a threshold (or a threshold value) indicating completion of the streak and conclusion of the card game, the host may determine a reward for the user (116). For example, the host may award the user credits based on how many completed streaks the user has achieved. The host may determine or calculate the number of credits awarded based on a pay table. The pay table may include credit amounts corresponding to the number of completed streaks. For example, a single completed streak may award 10 credits, two completed streaks may award 25 credits, three completed streaks may award 100 credits, four completed streaks may award 750 credits, and five completed streaks may award 12500 credits. Although specific credit values are provided, it should be understood that the values may be changed as desired by the host and the reward may include rewards other than credits in accordance with one or more embodiments of the present disclosure.

In one or more embodiments, the reward provided by the host may be increased based on aspects of one or more cards dealt (or displayed) for the plurality of lines. For example, in the event that the player achieves a particular combination of cards based on the pay table, the user may receive a bonus corresponding to the combination of cards in accordance with the pay table. In one or more embodiments, the pay table may include one or more poker hands of particular ranks and the player may receive a bonus corresponding to the one or more poker hands, if present, at the conclusion of the card game. For example, a bonus may be awarded for a royal flush, a straight flush, a four of a kind, a full house, a straight, a three of a kind, two pair, and/or the like. Further, multiples of the bonus may be awarded in accordance with the pay table set by the host. Although a poker hand is provided as an example, any combination of one or more cards may be used to determine or calculate a corresponding bonus from the pay table.

In one or more embodiments, a change in the pay table may occur between different plays of the card game. For example, the reward may increase as users end the card game without a reward or without a set type or category of rewards. In one or more embodiments, a particular combination of cards may serve as a progressive jackpot (e.g., a bonus value or jackpot value that increases with every play and resets to a lower value when a user achieves the particular combination of cards). In one or more embodiments, the particular combination of cards may be a royal flush. A change in the pay table may also occur between different plays of the card game when the host allows the user to decide the wager amount. For example, doubling the amount of a wager may double the reward provided in accordance with the pay table. However, the present disclosure is not limited thereto. For example, any suitable multiplier or change in pay table may be provided as desired by the host.

In one or more embodiments, the bonus may be based on a combination of cards from one or more bonus lines of play arranged in the first direction (e.g., the row direction) and/or the second direction (e.g., the column direction). However, the present disclosure is not limited thereto. For example, any variations of one or more bonus lines may be drawn from an end of the lines of play to another end (e.g., an opposite end) of the lines of play forming a matrix arrangement. The bonus lines may be a single straight segment (e.g., a vertical segment, a horizontal segment, or a diagonal segment) or a series of sequential segments forming a bonus line extending from an end of the lines of play to another end of the lines of play. Based on the bonus lines, the host may identify and award the bonus to the user. For example, a processing circuit may automatically identify the bonus corresponding to the bonus lines and provide the reward including the bonus to the user.

In one or more embodiments, all of the dealt (or displayed) cards regardless of whether the cards are part of completed streaks may be considered for the bonus in accordance with the pay table. However, the present disclosure is not limited thereto. For example, in one or more embodiments, only cards of completed streaks may be considered for the bonus. As another example, the cards that are part of the completed streaks and only some of the dealt (or displayed) cards in inactive lines may be considered for the bonus.

In one or more embodiments, the host may determine the best hand (e.g., hand resulting in the highest bonus from the pay table) from among all of the cards that are part of the completed streaks. However, the present disclosure is not limited thereto. For example, the host may determine the best hand from among all of the cards that were dealt (or displayed) during the card game. Based on the best hand, the host may reward the user with a corresponding bonus in accordance with the pay table.

With reference to FIG. 1B, acts 102, 104, 106, 108*b*, 110, 112, 114, and 116 may be the same or substantially the same as corresponding acts 102, 104, 106, 108*a*, 110, 112, 114, and 116 described with respect to FIG. 1A, and therefore, a redundant description thereof may not be repeated.

As shown in FIG. 1B, the method 100*b* of conducting a card game may further include, in response to dealing (or displaying) the next card for the active lines, determining active lines from among the lines of play (e.g., the remaining active lines of play) based on the presence of an auto-win card (107). In one or more embodiments, the auto-win card may be a highest card and/or a lowest card from among the deck as set by the host. For example, in the case where an ace is the highest in value and a two is the lowest in value, the auto win card may be an ace and/or a two. In this case, when an ace or two is dealt (or displayed) by the host to an active line, an auto-win condition may be fulfilled. The auto-win condition indicates that regardless of the indication of the user and the next card dealt (or displayed) for the corresponding active line, the corresponding active line should remain an active line.

For example, if the auto-win card is a second card in an active line then the active line remains active regardless of the third card dealt (or displayed), by the host, to the active line. In this case, in one or more embodiments, an auto-win placeholder may be provided in the position where the third card will be dealt (or displayed), by the host, in the corresponding active line. As such, a card in the position of the auto-win placeholder may be revealed when the third card is dealt (or displayed), by the host, to the active line including the auto-win placeholder. Although an auto-win placeholder is described, the present disclosure is not limited thereto and any suitable placeholder or no placeholder at all may be used without impacting gameplay.

Subsequently, if the third card does not satisfy the auto-win condition (i.e., is not an auto-win card), the active line is no longer protected from being rendered inactive by the next card dealt (or displayed) to the active line. In this case, an auto-win placeholder may not be present in the position where a fourth card may be dealt (or displayed) thereby indicating that the active line is not protected from being rendered inactive by, for example, an incorrect indication of whether the fourth card is higher or lower in value than the third card.

For active lines of play where the auto-win condition is not satisfied, the host may determine active lines from among the lines of play based on the indication of the user for lines of play (108*b*).

Although the highest card and the lowest card of the deck are presented as fulfilling auto-win conditions, the present disclosure is not limited thereto. For example, other cards may be used to fulfill auto-win conditions such as an eight. In one or more embodiments, the auto-win card may be a wild card included in the deck. The wild card may be a card selected from a standard deck of 52 cards or may be a different card used to indicate an auto-win.

With reference to FIG. 1C, acts 102, 104, 106, 108*b*, 110, 112, 114, and 116 may be the same or substantially the same as the acts 102, 104, 106, 108*b*, 110, 112, 114, and 116 described with respect to FIG. 1B, and therefore, a redundant description thereof may not be repeated.

As shown in FIG. 1C, the method 100*c* of conducting a card game may further include providing a prompt to a user to elect or reject replacement cards (103). For example, the user may replace the first cards from among the active lines or replace subsequently dealt cards (e.g., the cards most recently dealt (or displayed) by the host to the active lines) prior to providing a response indicating whether the next cards will be higher or lower in value.

Based on a response of the user, the host may determine whether the user elected to replace one or more cards dealt (or displayed) by the host (118). In the case where the user rejects replacement cards, play proceeds consistent with the acts 104, 106, 107, 108*b*, 110, 112, and 114 described with respect to FIG. 1B until a subsequent prompt to a user to elect or reject replacement cards (103) or the streak equals a threshold (114) indicating conclusion of the card game.

In the case where the user elects to replace cards, the host may determine which cards to replace (120). In one or more embodiments, the election to replace cards replaces only the last card or most recently dealt (or displayed) card for each active line. In this case, the last card for each active line is removed from the lines of play and the host deals (or displays) a replacement card (122) from the one or more decks used for the corresponding lines of play. However, the present disclosure is not limited thereto. For example, in one or more embodiments, the host may allow the user to select which cards to replace in accordance with any suitable rules desired by the host.

After replacing the cards, the host may then provide, to the user, the prompt to indicate whether a next card will be higher or lower in value than the preceding card for active lines from among the lines of play (104). Play may then proceed consistent with the acts 104, 106, 107, 108*b*, 110, 112, and 114 described with respect to FIG. 1B until a subsequent prompt to a user to elect or reject replacement cards (103) or the streak equals a threshold (114) indicating conclusion of the card game.

In one or more embodiments, at the conclusion of the card game prior to determining the reward for the user (116), the host may provide a prompt to a user to elect or reject replacement cards. In this case, the user may elect to replace cards to increase the odds of achieving, for example, a particular combination of cards in accordance with the pay table. The host may follow the same or a substantially similar process to acts 118, 120, and 122 prior to determining the reward for the user (116), and therefore, a redundant description thereof will not be repeated. In one or more embodiments, in response to the user electing replacement cards at the conclusion of the card game, the host may request additional credits from the user or may reduce the pay out from the pay table.

Although the method 100*c* of FIG. 1C illustrates the prompt to a user to elect or reject replacement cards at a particular position of the flow chart, the present disclosure is not limited thereto. For example, in one or more embodiments, the prompt to elect or reject replacement cards may be always present such that the user may elect replacement cards for a set of cards (e.g., a column of cards corresponding to one card per line of play) at any time before the host determines the reward for the user. Further, the prompt may be provided, by the host, concurrently or simultaneously with other prompts. In one or more embodiments, the user may also place a side bet on a particular outcome resulting from the replacement cards.

Further, although the method 100*c* of FIG. 1C includes auto-win cards and auto-win conditions, the present disclosure is not limited thereto. For example, the auto-win condition may be omitted as shown in FIG. 1A while including the card replacement feature of FIG. 1C. In other words, acts 107 and 108*b* of FIG. 1C may be replaced with act 108*a* of FIG. 1A in accordance with one or more embodiments of the present disclosure.

In one or more embodiments, the host may conduct a plurality of card games concurrently (e.g., simultaneously) for multiple users. In this case, the users may compete with each other to achieve set goals. For example, the users may race each other to achieve a set number of completed streaks (e.g., 100 completed streaks) or a highest reward total within a period of time. In this case, the first user to achieve the set goal may receive an additional reward from the host.

In one or more embodiments, the host may provide the users with information regarding the other users, the card game of the other users, and/or the status of the other user's progress toward the set goal. As such, the users may be aware of the other users while competing to achieve the set goal.

Although a number of completed streaks and a reward total are provided as examples of set goals, the present disclosure is not limited thereto. For example, any suitable aspect of the card game may be tracked to provide set goals with corresponding rewards. Further, users may race to achieve a plurality of different goals with corresponding rewards.

Figure 2:
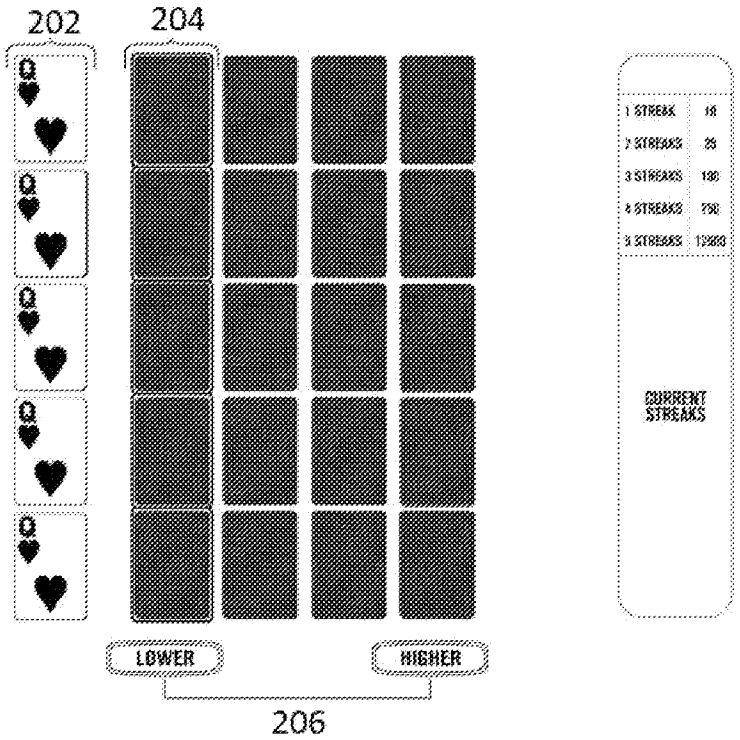
FIG. 2 is a diagram illustrating an example of a prompt for a game of chance according to one or more embodiments of the present disclosure.
Figure 3:
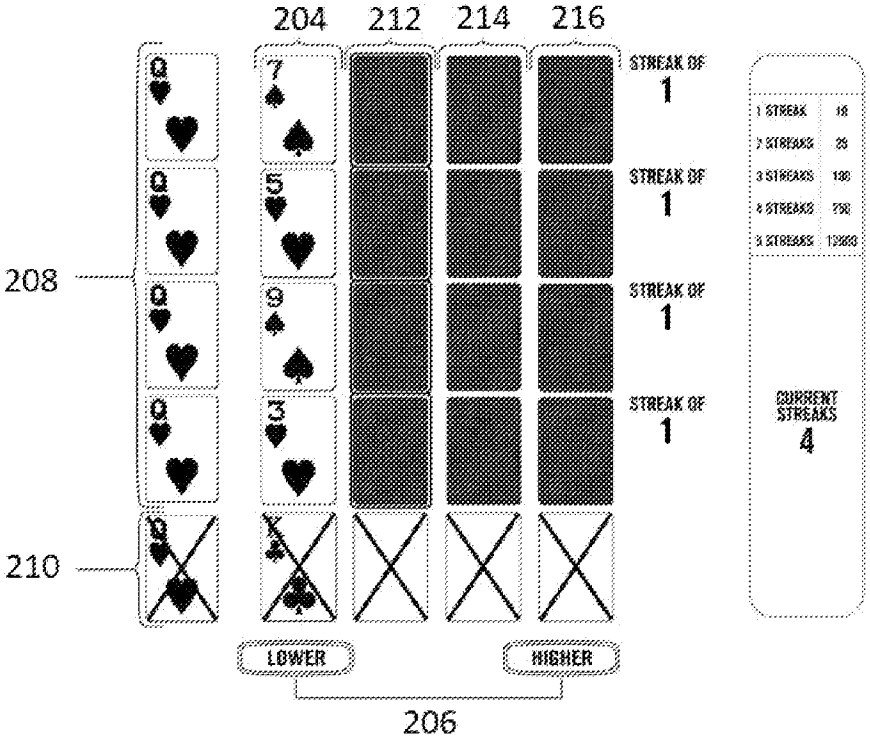
FIG. 3 is a diagram illustrating the result of an indication made by the user in FIG. 2 according to one or more embodiments of the present disclosure.

FIG. 2 is a diagram illustrating an example of a prompt for a game of chance according to one or more embodiments of the present disclosure. FIG. 3 is a diagram illustrating the result of an indication made by the user in FIG. 2 according to one or more embodiments of the present disclosure.

With reference to FIG. 2, the host deals (or displays) to the user a column of starting cards 202 where each of the starting cards 202 correspond to a separate line of play. The user may indicate whether the set of immediately subsequent cards (e.g., active cards) 204 in active lines will be higher or lower in value than the starting cards 202, utilizing the Higher or Lower buttons 206. As discussed with reference to FIG. 1A, the user may select the desired indication with their guess being valid for the set of immediately subsequent cards 204. However, the present disclosure is not limited thereto.

With reference to FIG. 3, after the user indicates Higher or Lower, utilizing the Higher or Lower buttons 206, the user is dealt the immediately subsequent cards (e.g., the resulting cards) 204. In this case, the user indicated Lower based from the diagram shown in FIG. 2. As shown in FIG. 3, for each card guessed correctly, the corresponding line of play may remain an active line 208. However, for each card guessed incorrectly, the corresponding line of play may become an inactive line 210 and may be unavailable for play. Play continues in this fashion for the next set 212 of dealt (or displayed) cards corresponding to active lines 208, and then for each respective set 214 and 216 of dealt (or displayed) cards corresponding to remaining active lines where the user guesses correctly.

Figure 4:
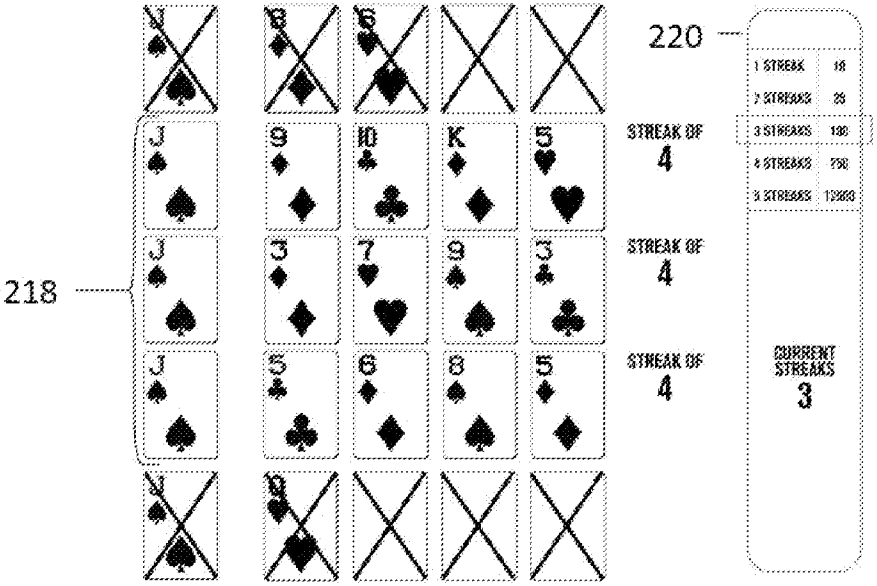
FIG. 4 is a diagram illustrating a successful completion of a streak according to one or more embodiments of the present disclosure.

FIG. 4 is a diagram illustrating a successful completion of a streak according to one or more embodiments of the present disclosure.

With reference to FIG. 4, upon the successful completion of at least one streak 218 of a set length (e.g., a predetermined length) of correct Higher or Lower guesses, the host may use a pay table to pay the user in accordance with the pay table 220. As shown in FIG. 4, the threshold value of four was set by the host such that completed streaks 218 each include a first card (e.g., a starting card) and four additional cards dealt (or displayed) by the host based on correct indications by the user. Two lines of play (the uppermost and lowermost lines of play shown in FIG. 4) were rendered inactive due to incorrect indications by the user at different stages of the game. Accordingly, the host may reward the user with 100 credits in accordance with the pay table 220.

Figure 5:
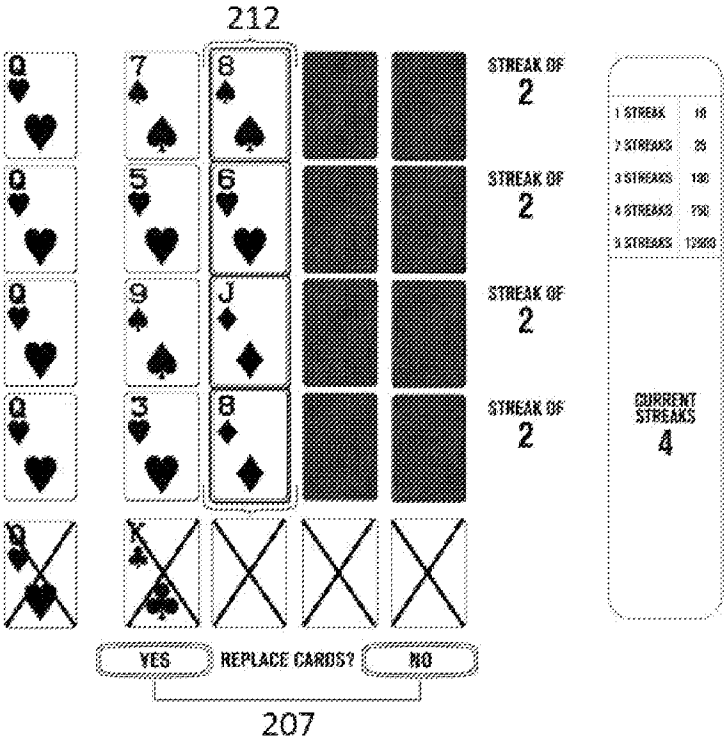
FIG. 5 is a diagram illustrating a prompt to elect a card replacement presented to the user according to one or more embodiments of the present disclosure.
Figure 6:
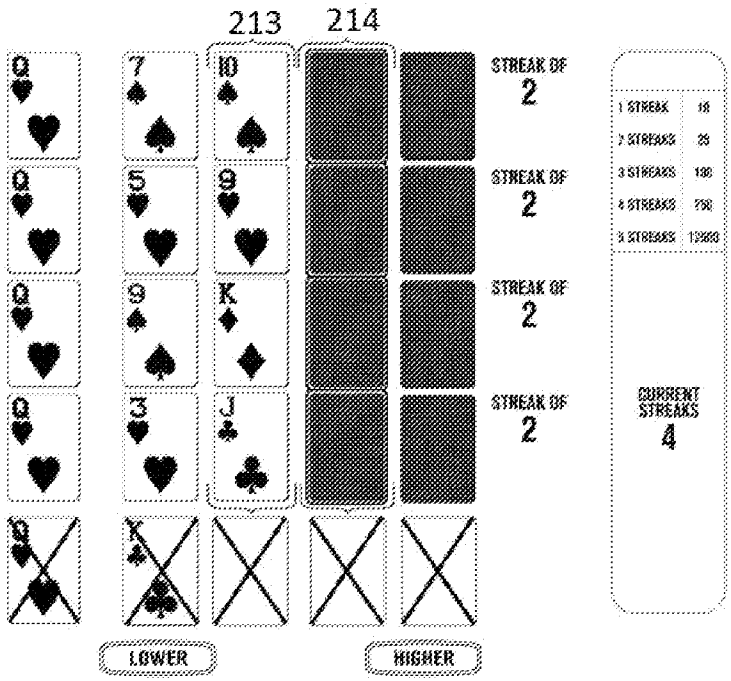
FIG. 6 is a diagram illustrating the decision to replace cards made by the user in FIG. 5 according to one or more embodiments of the present disclosure.

FIG. 5 is a diagram illustrating a prompt to elect a card replacement presented to the user according to one or more embodiments of the present disclosure. FIG. 6 is a diagram illustrating the decision to replace cards made by the user in FIG. 5 according to one or more embodiments of the present disclosure.

With reference to FIG. 5, one or more embodiments of the present disclosure as discussed with reference to FIG. 1C provide the player with the option 207 to elect to replace the most recent set of cards dealt (or displayed), providing the player a chance to improve their odds of continuing one or more streaks. In one or more embodiments, the option to elect to replace the set of cards may improve the odds of achieving a higher reward (e.g., a combination of cards corresponding to a bonus) in accordance with a pay table.

With reference to FIG. 6, the user elected to replace the most recent set of cards corresponding to active lines of play and the host has now dealt (or displayed) a new set 213 of cards. As such, the user may have a new set 213 of cards from which to base their next Higher or Lower decision for the next set 214 of cards corresponding to active lines of play.

Figure 7:
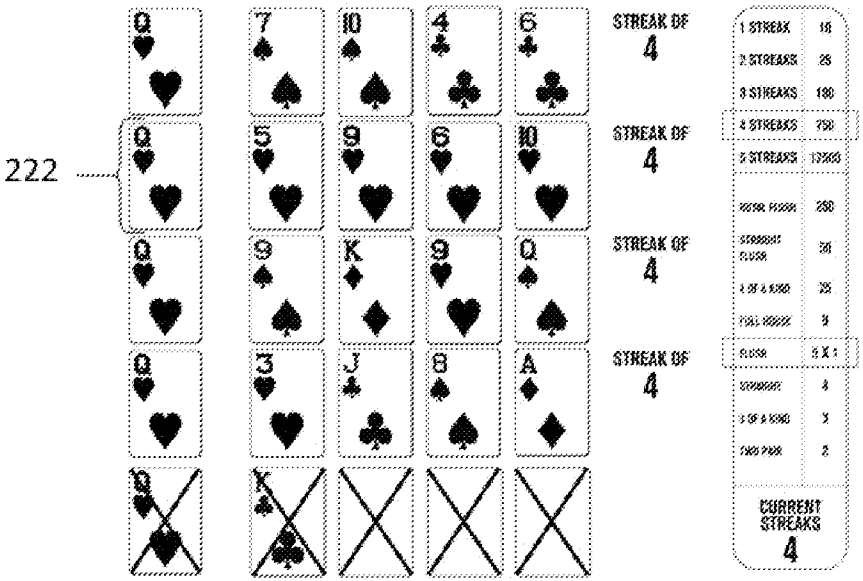
FIG. 7 is a diagram illustrating a horizontal poker bonus awarded to the user according to one or more embodiments of the present disclosure.

FIG. 7 is a diagram illustrating a horizontal poker bonus awarded to the user according to one or more embodiments of the present disclosure.

With reference to FIG. 7, one or more embodiments of the present disclosure provide the user an increased reward (e.g., a reward including a bonus) for the completion of one or more successful streaks which also result in a particular combination of cards. In this case, a poker hand shown in the pay table of FIG. 7. Here, the poker hand rank of a flush is achieved in the second line of play 222 with the suit of all cards being hearts. Therefore, as indicated in the pay table, a bonus value of 5 is added to the base reward 750 for one flush identified from among the active lines in the first direction (e.g., a horizontal direction or a row direction).

Figure 8:
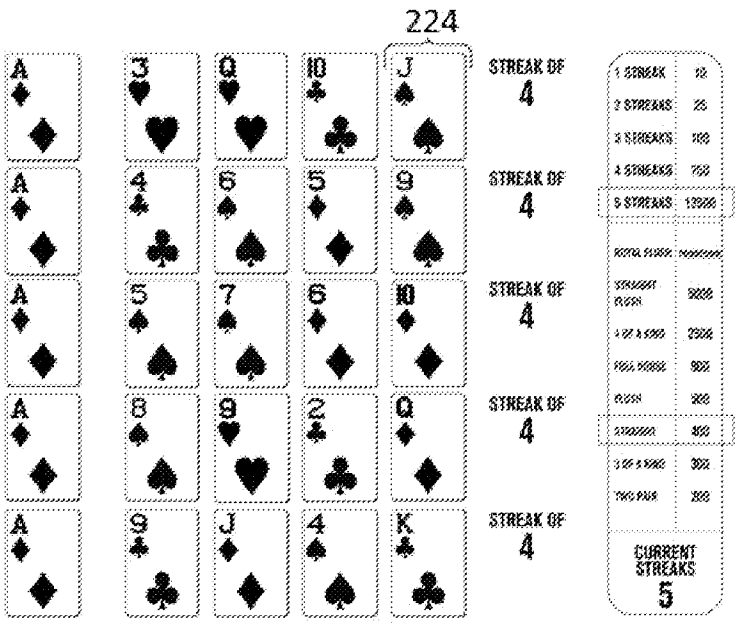
FIG. 8 is a diagram illustrating a vertical poker bonus awarded to the user according to one or more embodiments of the present disclosure.

FIG. 8 is a diagram illustrating a vertical poker bonus awarded to the user according to one or more embodiments of the present disclosure.

With reference to FIG. 8, one or more embodiments of the present disclosure provide the user an increased reward (e.g., a reward including a bonus) for the completion of five successful streaks whose concluding cards form a particular combination of cards. In this case, a poker hand. Here, the concluding cards 224 form a poker hand rank of a straight in a column formed of the last card dealt (or displayed) to the active lines. Therefore, as indicated in the pay table, a bonus value of 400 is added to the base reward of 12500 for one straight identified from among the active lines in the second direction (e.g., a column direction or a vertical direction).

Figure 9:
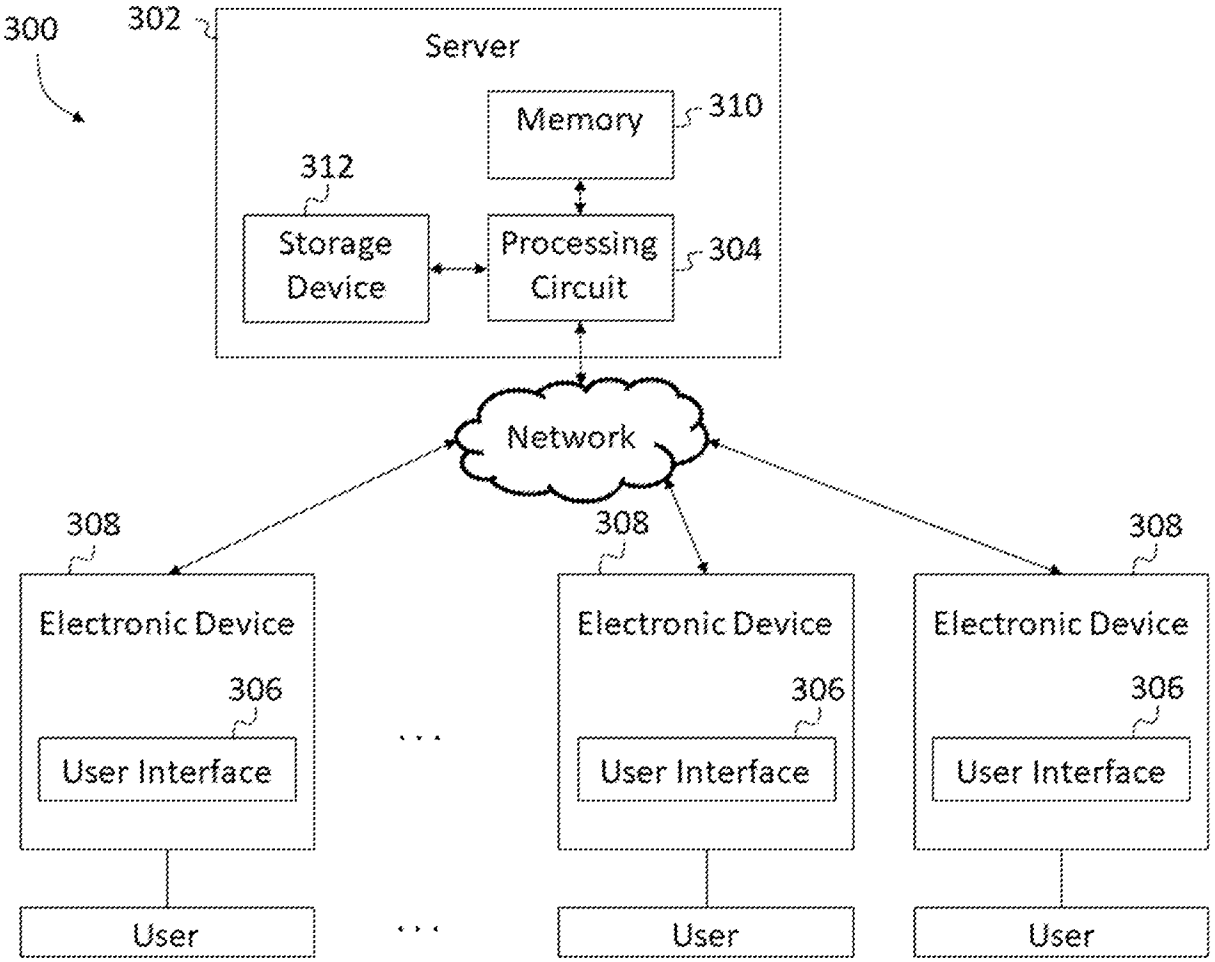
FIG. 9 is a block diagram illustrating various computer systems communicating with each other to implement one or more embodiments of the present disclosure.

FIG. 9 is a block diagram illustrating various computer systems communicating with each other to implement one or more embodiments of the present disclosure.

In one or more embodiments, the system 300 for conducting the card game may be hosted on a server 302 including a processing circuit 304, and each user may use a user interface (e.g., in a web browser or application) 306 displayed by a display device of an electronic device 308 including a processing circuit. The server 302 may receive input or responses from one or more users, provide prompts (e.g., a high-low indication and/or a replace card option) pending response from the user, determine active lines, determine rewards based on a pay table, and/or coordinate competitive events.

In one or more embodiments, the electronic device 308 to be used by one or more users may be a hand-held electronic device such as a tablet, phone, and the like, or a larger electronic device such as a game station, a personal computer (PC), a television, or the like. The electronic device 308 may include a display device (e.g., a display device including a display screen and/or a touch screen), a touchpad, a voice-guided input device, a mouse, a keyboard, a microphone, speakers, and/or the like.

As shown in FIG. 9, the server 302 according one or more embodiments of the present disclosure connects to electronic devices 308 to be operated by one or more users to perform the operations described herein. For example, the server 302 may include the processing circuit 304 configured to run an application providing the functionality of some embodiments. Such an application may serve, to each of a plurality of users (e.g., a respective web browser or application interface operated by the user) pages implementing user interfaces 306 such as those shown in FIGS. 2-8 allowing each user to submit bets or wagers, respond, and view results. The application may further determine active lines, provide prompts, and determine rewards automatically in response to user responses or inputs. For example, the application may replace cards (e.g., a column of cards), deal cards (e.g., deal the next column of cards corresponding to separate lines of play), and/or calculate and distribute payouts based on a pay table. In one or more embodiments, the application may be distributed (e.g., a portion of the application that sends and receives input from the user interfaces runs on a different device than a device that calculates and/or distributes payouts). The server 302 may be connected via a data network such as, for example, a local area network or a wide area network (e.g., a public Internet) to send and receive information to any electronic devices (e.g., electronic devices 308) that can receive and transmit data via the data network. In one or more embodiments, the electronic devices 308 may connect to the electronic communication system using a telephone connection, satellite connection, cable connection, radio frequency communication, or any suitable wired or wireless data communication mechanism.

In one or more embodiments, the server 302 includes a storage device 312 or mass storage device (or database) such as, for example, a disk drive, drive array, flash memory, magnetic tape, or other suitable storage device for storing information used by the server. The server 302 may store data relating to the server 302, the electronic devices 308, users of the electronic devices 308, historical records, analytics, metadata, and/or any other suitable information. Although the storage is included in the server 302 as illustrated in FIG. 9, the present disclosure is not limited thereto. For example, the server 302 may be connected to an external storage device that is not a part of the server 302, in which case, the storage device of the server 302 may be used in addition to the external storage device or be omitted entirely.

In one or more embodiments, the server 302 includes memory connected to the processing circuit 304. The processing circuit 304 may include a processor which executes program instructions from the memory to perform the functions of the software. The memory (e.g., memory, memory unit, storage device, and/or the like) 310 may include one or more devices (e.g., RAM, ROM, Flash memory, hard disk storage, and/or the like) for storing data and/or computer code for completing or facilitating the various processes described for the software. For example, the memory 310 may be for storing image data, event data, user input data, random or pseudo-random number generators, pay table data (e.g., pay table data including a progressive jackpot synchronized among multiple electronic devices 308), and/or the like. The memory 310 may be or include volatile memory and/or non-volatile memory.

Various portions of embodiments of the present disclosure that refer to the use of a "processing circuit" may be implemented with logic gates, or with any other embodiment of a processing unit or processing circuit. The term "processing unit" or "processing circuit" is used herein to include any combination of hardware, firmware, and software, employed to process data or digital signals.

Figure 10:
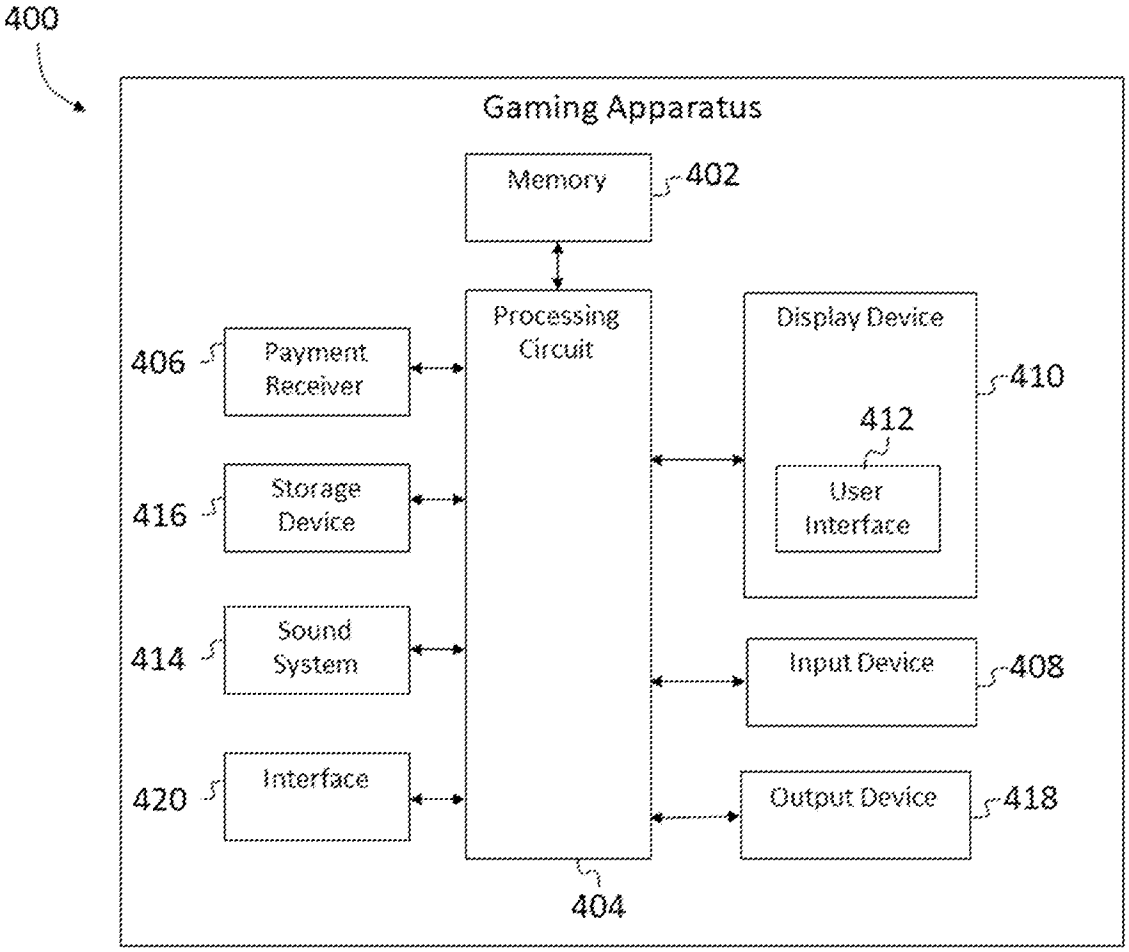
FIG. 10 is a block diagram illustrating a system including a gaming apparatus to implement one or more embodiments of the present disclosure.

FIG. 10 is a block diagram illustrating a system including a gaming apparatus 400 to implement one or more embodiments of the present disclosure.

With reference to FIG. 10, the gaming apparatus 400 includes memory 402 communicably connected to the processing circuit 404. The processing circuit 404 may include a processor which executes program instructions from the memory to cause the gaming apparatus 400 to perform specific actions and exhibit specific behavior as described herein. In one or more embodiments, the memory (e.g., memory, memory unit, storage device, and/or the like) 402 may include one or more devices (e.g., RAM, ROM, Flash memory, hard disk storage, and/or the like) for storing data and/or computer code for completing or facilitating the various processes described for the software. For example, the memory 402 may be for storing image data, event data, user input data, random or pseudo-random number generators, pay table data, and/or the like. The memory 402 may be or include volatile memory (e.g., random access memory ("RAM"), static RAM, dynamic RAM, etc.) and/or non-volatile memory (e.g., read-only memory ("ROM"), programmable ROM ("PROM"), erasable programmable ROM ("EPROM"), electrically erasable programmable ROM "EEPROM"), flash memory, etc.).

The gaming apparatus 400 may include a payment receiver 406 communicably connected to the processing circuit 404. The payment receiver 406 may include a scanner, a card reader, a coin slot, a bill receptacle, and/or the like for receiving payment from a user to be converted into in-game credits. A user may insert coins, paper currency, tokens, tickets, vouchers, and/or the like. In response to receiving an input from the user, the processing circuit 404 connected to the payment receiver 406 may determine the validity of the input and determine the value of credits allocated for the input to be used in a card game conducted in accordance with the methods described herein.

After determining a sufficient number of credits have been entered, the processing circuit 404 may enable an input device 408 connected to the processing circuit 404. The input device 408 may, for example, be a game activation device such as a pull arm, play button, or the like. In one or more embodiments, the input device 408 may be an alphanumeric input device, such as a keyboard, that may include alphanumeric and/or function keys, and/or a cursor control device implemented using a device such as a mouse, a track-ball, a track-pad, an optical tracking device, or a touch screen.

The input device 408 may be a single input device or a plurality of input devices providing different options. For example, in the case of the plurality of input devices, different input devices may be, for example, buttons corresponding to different bet amounts, repeat of a bet amount from the previous play, any options, elections, and/or indications presented by the software during gameplay, cash out, and/or the like.

In one or more embodiments, the input device 408 may be or part of a touchpad or a touchscreen of the gaming apparatus 400. In the case of a touchscreen, the input device 408 may be part of a display area of a display device 410 of the gaming apparatus 400 for displaying a user interface 412 including the card game or a separate display area spaced from the display area for displaying the card game.

In one or more embodiments, the gaming apparatus 400 includes one or more display devices 410 communicably connected to the processing circuit 404. The one or more display devices 410 may include one or more display areas arranged in any suitable location or locations on a housing of the gaming apparatus 400. Based on signals sent from the processing circuit 404, the one or more display devices 410 may display information associated with the card game and a user interface 412 including information allowing a user to respond to prompts and view results such as those shown in FIGS. 2-8.

The gaming apparatus 400 may include a sound system 414 communicably connected to the processing circuit 404. The sound system 414 may include sound generating hardware and/or software for playing music and/or other sounds relating to the card game. For example, the sound system 414 may provide dynamic sounds relating to rewards, game modes (e.g., game variations), and/or the like. The sound system 414 may play sounds corresponding to one or more images displayed by the one or more display devices to create an audiovisual effect to attract potential users and/or improve a user experience.

In one or more embodiments, the gaming apparatus 400 may include a storage device 416 connected to the processing circuit 404 for storing data relating to associated electronics devices, user identification, gameplay records, metadata, and/or any other suitable information. However, the present disclosure is not limited thereto. For example, data stored in the storage device 416 may be stored in the memory 402 and the storage device 416 may be omitted.

In the event that a user decides to stop playing the gaming apparatus 400, the user may select an option to stop (e.g., selecting a cash out option). In this case, the processing circuit 404 may calculate the winnings of the user and an output device 418 of the gaming apparatus 400 may issue a suitable form of payment to the user (e.g., coins, cash, credits, tickets, vouchers, and/or the like).

In one or more embodiments, the gaming apparatus 400 may include an interface 420 for interfacing with external devices (e.g., other electronic devices and computer systems). The communication interfaces implemented by the one or more interfaces may include wireline (e.g., serial cables, modems, network adaptors, etc.) and/or wireless (e.g., wireless modems, wireless network adaptors, etc.) communication technology.

For example, the interface 420 may enable multiple gaming apparatuses 400 to connect to a server and/or each other to provide multi-user events as described herein. For example, interface 420 of each gaming apparatus 400 may be connected to a server for synchronizing the gaming apparatuses 400. The server may have the functionality of the server 302 described with reference to FIG. 9 or may be a server with other and/or additional functionality. In one or more embodiments, the server may track and/or synchronize information such as user identifications, metadata, analytics, and/or rewards. The server may, for example, track and synchronize a progressive jackpot among multiple gaming apparatuses 400.

Accordingly, as disclosed herein, one or more embodiments of the present disclosure provide a method and system of conducting a card game including multiple lines of play with dependent choices.

While various methods according to some embodiments of the present disclosure has been described according to various processes having a certain process order, the present disclosure is not limited thereto. For example, when a certain embodiment may be implemented differently, a specific process order may be different from the described order. For example, two consecutively described processes may be performed at the same or substantially at the same time, or may be performed in an order opposite to the described order.

It will be understood that, although the terms "first," "second," "third," etc., may be used herein to describe various elements, components, regions, and/or sections, these elements, components, regions, and/or sections should not be limited by these terms. These terms are used to distinguish one element, component, region, layer or section from another element, component, region, or section. Thus, a first element, component, region, or section described below could be termed a second element, component, region, or section, without departing from the spirit and scope of the present disclosure.

It will be understood that when an element or layer is referred to as being "on," "connected to," or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments and is not intended to be limiting of the present disclosure. As used herein, the singular forms "a" and "an" are intended to include the plural forms as well, unless the context clearly indicates otherwise. It will be further understood that the terms "comprises," "comprising," "includes," "including," "has," "have," and "having," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. For example, the expression "A and/or B" denotes A, B, or A and B.

As used herein, the term "substantially," "about," and similar terms are used as terms of approximation and not as terms of degree, and are intended to account for the inherent variations in measured or calculated values that would be recognized by those of ordinary skill in the art. Further, the use of "may" when describing embodiments of the present disclosure refers to "some embodiments of the present disclosure." As used herein, the terms "use," "using," and "used" may be considered synonymous with the terms "utilize," "utilizing," and "utilized," respectively.

Unless otherwise defined, all terms (including technical and scientific terms) used herein have the same meaning as commonly understood by one of ordinary skill in the art to which the present disclosure belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

Although some example embodiments have been described, those skilled in the art will readily appreciate that various modifications are possible in the example embodiments without departing from the spirit and scope of the present disclosure. It will be understood that descriptions of features or aspects within each embodiment should typically be considered as available for other similar features or aspects in other embodiments, unless otherwise described. Thus, as would be apparent to one of ordinary skill in the art, features, characteristics, and/or elements described in connection with a particular embodiment may be used singly or in combination with features, characteristics, and/or elements described in connection with other embodiments unless otherwise specifically indicated. Therefore, it is to be understood that the foregoing is illustrative of various example embodiments and is not to be construed as limited to the specific example embodiments disclosed herein, and that various modifications to the disclosed example embodiments, as well as other example embodiments, are intended to be included within the spirit and scope of the present disclosure as defined in the appended claims, and their equivalents.

What is claimed is:

1. A method of conducting a game of chance, the method comprising:

displaying on a display device, by a processing circuit, a plurality of first cards for active lines from among a plurality of lines of play, each of the plurality of first cards being from a different standard deck of cards;

displaying on the display device, by the processing circuit, first and second prompts for eliciting a first response from a user, wherein the first prompt is: an indication that a next card will be higher in value than a preceding card for an active line from among the active lines; and wherein the second prompt is an indication that a next card will be lower in value than a preceding card for an active line from among the active lines;

in response to receiving, by the processing circuit, the first response from the user: displaying, by the processing circuit, a next card for the active lines; and determining, by the processing circuit, active lines remaining from among the plurality of lines of play based on the indication of the first response;

updating, by the processing circuit, a streak number corresponding to a number of responses in the game that comprise indications resulting in active lines remaining from among the plurality of lines of play;

automatically determining, by the processing circuit, a reward based on the active lines remaining from among the plurality of lines of play in response to the streak number reaching a threshold value; and automatically awarding the determined reward to the user.

2. The method of claim 1, wherein the active lines from among the plurality of lines of play comprise cards displayed, by the processing circuit, from respective standard decks of cards.

3. The method of claim 1, wherein the first cards for the active lines are equal to each other in value.

4. The method of claim 1, the method further comprising providing, by the processing circuit, a prompt for eliciting a second response, the second response comprising an election to replace one or more cards in the plurality of lines.

5. The method of claim 1, wherein prior to receiving, by the processing circuit, the first response, the method further comprises determining, by the processing circuit, that an active line remains from among the plurality of lines of play based on an auto-win card regardless of the first response and the next card for the active line.

6. The method of claim 1, the method further comprising providing, by the processing circuit, a prompt for eliciting a third response, the third response comprising an option to place a side bet to protect against a chance of a tie between the next card and the preceding card.

7. The method of claim 1, the method further comprising increasing, by the processing circuit, the reward based on a combination of cards in accordance with a pay table.

8. The method of claim 7, wherein the combination of cards comprises cards from two or more of the active lines remaining from among the plurality of lines of play in response to the streak number reaching the threshold value.

9. A system configured to conduct a game of chance, the system comprising a display device to display a user interface and a processing circuit connected to the display device, the system being configured to:

display on a display device, by the processing circuit, a plurality of first cards for active lines from among a plurality of lines of play, each of the plurality of first cards being from a different standard deck of cards;

display on the display device, by the processing circuit, first and second prompts for eliciting a first response from a user, wherein the first prompt is an indication that a next card will be higher in value than a preceding card for an active line from among the active lines; and wherein the second prompt is an indication that a next card will be lower in value than a preceding card for an active line from among the active lines;

in response to receiving, by the processing circuit, the first response from the user:

display, by the processing circuit, a next card for the active lines; and determine, by the processing circuit, active lines remaining from among the plurality of lines of play based on the indication of the first response;

update, by the processing circuit, a streak number corresponding to a number of responses in the game that comprise indications resulting in active lines remaining from among the plurality of lines of play;

automatically determine, by the processing circuit, a reward based on the active lines remaining from among the plurality of lines of play in response to the streak number reaching a threshold value; and automatically award the reward to the user.

10. The system of claim 9, wherein the active lines from among the plurality of lines of play comprise cards displayed, by the processing circuit, from respective standard decks of cards.

11. The system of claim 9, wherein the first cards for the active lines are equal to each other in value.

12. The system of claim 9, wherein the system is configured to provide, by the processing circuit, a prompt for eliciting a second response, the second response comprising an election to replace one or more cards in the plurality of lines.

13. The system of claim 9, wherein, prior to receiving, by the processing circuit, the first response, the system is configured to determine, by the processing circuit, that an active line remains from among the plurality of lines of play based on an auto-win card regardless of the first response and the next card for the active line.

14. The system of claim 9, wherein the system is configured to provide, by the processing circuit, a prompt for eliciting a third response, the third response comprising an option to place a side bet to protect against a chance of a tie between the next card and the preceding card.

15. The system of claim 9, wherein the system is configured to increase, by the processing circuit, the reward based on a combination of cards in accordance with a pay table.

16. The system of claim 15, wherein the combination of cards comprises cards from two or more of the active lines remaining from among the plurality of lines of play in response to the streak number reaching the threshold value.

* * * * *